US009786991B2

(12) United States Patent
Chung et al.

(10) Patent No.: US 9,786,991 B2
(45) Date of Patent: Oct. 10, 2017

(54) CROSS-TYPE TRANSMISSION MODULE AND ASSEMBLY METHOD THEREOF

(71) Applicant: Wistron NeWeb Corp., Hsinchu (TW)

(72) Inventors: Bing-Chun Chung, Hsinchu (TW); Chia-Shang Cheng, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 236 days.

(21) Appl. No.: 14/227,623

(22) Filed: Mar. 27, 2014

(65) Prior Publication Data

US 2015/0061957 A1 Mar. 5, 2015

(30) Foreign Application Priority Data

Aug. 28, 2013 (TW) ..... 102130753 A

(51) Int. Cl.
*H01Q 9/28* (2006.01)
*H01Q 15/14* (2006.01)
(Continued)

(52) U.S. Cl.
CPC ..... *H01Q 9/285* (2013.01); *H01Q 15/14* (2013.01); *H01Q 21/24* (2013.01); *H01Q 21/28* (2013.01); *Y10T 29/49016* (2015.01)

(58) Field of Classification Search
CPC ..... H01Q 21/26; H01Q 9/285; H01Q 15/14; H01Q 21/28; H01Q 21/24; Y10T 29/49016
(Continued)

(56) References Cited

U.S. PATENT DOCUMENTS 4,686,536 A * 8/1987 Allcock ..... H01Q 9/065 343/700 MS
5,052,936 A * 10/1991 Biechler ..... H01R 12/725 439/260
(Continued)

FOREIGN PATENT DOCUMENTS

CN 201114995 Y 9/2008
CN 101884183 A 11/2010
(Continued)

OTHER PUBLICATIONS

Nan Liu et al, "A Pattern Reconfigurable Printed Quasi-Yagi Antenna with Slots in the Directors", School of Electronic Information Engineering, Tianjin University, Dec. 2, 2010, (pp. 275-278).

*Primary Examiner* — Jessica Han
*Assistant Examiner* — Bamidele A Jegede
(74) *Attorney, Agent, or Firm* — Muncy, Geissler, Olds & Lowe, P.C.

(57) ABSTRACT

A method for assembling a cross-type transmission module is provided, which includes the following steps. First, a first circuit board and a second circuit board are provided, wherein the first circuit board includes a first antenna, and the second circuit board includes a first groove and a second antenna. Then, the first circuit board is inserted partially through the first groove along an insertion direction to connect the first circuit board to the second circuit board, wherein the first circuit board is on a first plane, the second circuit board is on a second plane, an included angle θ is formed between the insertion direction and the second plane, and the included angle is not zero. In this embodiment, the included angle is 90 degrees, and the second plane is perpendicular to the first plane.

18 Claims, 5 Drawing Sheets

(51) Int. Cl.
*H01Q 21/24* (2006.01)
*H01Q 21/28* (2006.01)

(58) Field of Classification Search
USPC ..... 343/797; 29/600
See application file for complete search history.

(56) References Cited

U.S. PATENT DOCUMENTS 5,268,701 A * 12/1993 Smith ..... H01Q 21/24 343/767
6,181,298 B1 * 1/2001 Strickland ..... H01Q 11/08 343/797
6,211,840 B1 * 4/2001 Wood ..... H01Q 9/065 343/793
6,369,778 B1 * 4/2002 Dockery ..... H01Q 1/36 343/895
6,529,172 B2 * 3/2003 Zimmerman ..... H01Q 9/28 343/795
7,173,566 B2 * 2/2007 Cheng ..... H01Q 1/38 343/700 MS
7,280,082 B2 * 10/2007 Theobold ..... H01Q 1/12 343/770
7,646,343 B2 * 1/2010 Shtrom ..... H01Q 3/242 343/700 MS
7,940,227 B2 * 5/2011 Chou ..... H01Q 9/16 343/795
8,242,966 B2 * 8/2012 Liu ..... H01Q 9/285 343/795
2003/0184497 A1 * 10/2003 Ye ..... H01Q 3/2658 343/909
2009/0184885 A1 * 7/2009 Chen ..... H01Q 21/0025 343/906
2010/0220457 A1 * 9/2010 Mukae ..... H05K 3/361 361/803
2011/0214515 A1 * 9/2011 Kim ..... B62D 6/10 73/862.325
2013/0017692 A1 * 1/2013 Que ..... H01R 12/732 439/65
2013/0027258 A1 * 1/2013 Chakam ..... H01Q 9/16 343/727
2013/0321215 A1 * 12/2013 Jiang ..... H01Q 1/38 343/700 MS

FOREIGN PATENT DOCUMENTS

CN 102055064 A 5/2011
EP 1622038 A2 2/2006
TW I323526 4/2010

* cited by examiner

CROSS-TYPE TRANSMISSION MODULE AND ASSEMBLY METHOD THEREOF

CROSS REFERENCE TO RELATED APPLICATIONS

This Application claims priority of Taiwan Patent Application No. 102130753, filed on Aug. 28, 2013, the entirety of which is incorporated by reference herein.

BACKGROUND OF THE INVENTION

Field of the Invention

The present invention relates to a cross-type transmission module, and in particular to a cross-type transmission module with improved gain.

Description of the Related Art

Long Term Evolution technology commonly utilizes directional dipole antennas to transmit signals. The directional dipole antennas are disposed on a cross-type transmission module. The cross-type transmission module comprises two intersected circuit boards and a reflective cover. The circuit boards are secured on the reflective cover. Conventionally, each circuit board comprises a connection groove, which extends in a length direction of the circuit board and is located on the midst of the circuit board. Two circuit boards are vertically intersected with each other via the connection groove. However, the position and the dimension of the connection groove restrict the design flexibility of the circuit board.

BRIEF SUMMARY OF THE INVENTION

A method for assembling a cross-type transmission module is provided, which includes the following steps. First, a first circuit board and a second circuit board are provided, wherein the first circuit board includes a first antenna, and the second circuit board includes a first groove and a second antenna. Then, the first circuit board is inserted partially through the first groove along an insertion direction to connect the first circuit board to the second circuit board, wherein the first circuit board is on a first plane, the second circuit board is on a second plane, an included angle θ is formed between the insertion direction and the second plane, and the included angle is not zero. In this embodiment, the included angle is 90 degrees, and the second plane is perpendicular to the first plane.

Utilizing the cross-type transmission module and the assembly method of the embodiment of the invention, the first circuit board is partially inserted through the first groove along the insertion direction to connect the first circuit board to the second circuit board, and the insertion direction is perpendicular to the surface of the second circuit board. Compared to the conventional vertically intersected design, the first and second circuit boards of the embodiment of the invention are laterally intersected. Therefore, the dimension and the position of the first groove (connection groove) on the circuit board can be properly designed. The embodiment of the invention provides improved design flexibility. Additionally, the connection groove of the conventional vertically intersected design is longer, and the director cannot be disposed on the circuit board (the director would be cut off by the connection groove). In the embodiment of the invention, the first and second circuit boards are laterally intersected, the director can be disposed on the circuit board, and the length of the director can be similar to the width of the circuit board. The director can improve gain of the cross-type transmission module. The cross-type transmission module of the embodiment of the invention improves gain with low cost.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1B:
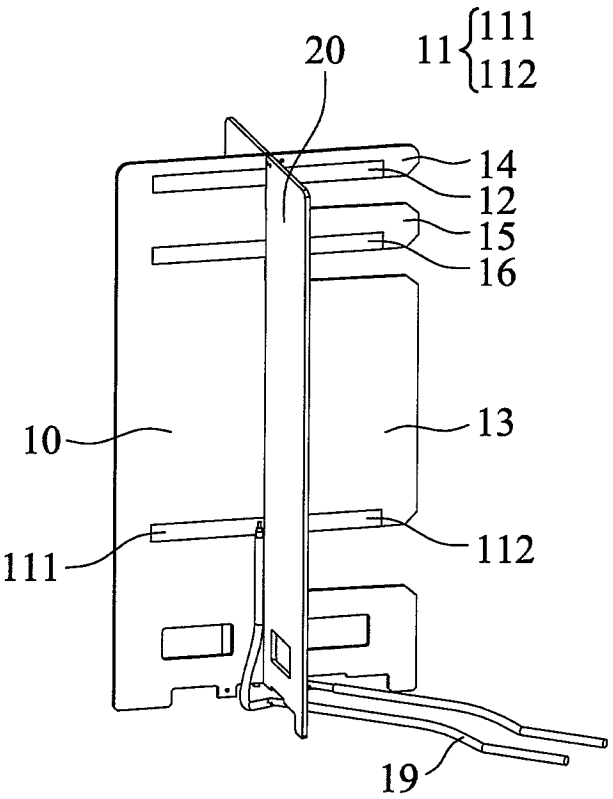
FIG. 1B shows another viewing angle of the cross-type transmission module of the embodiment of the invention.
Figure 1A:
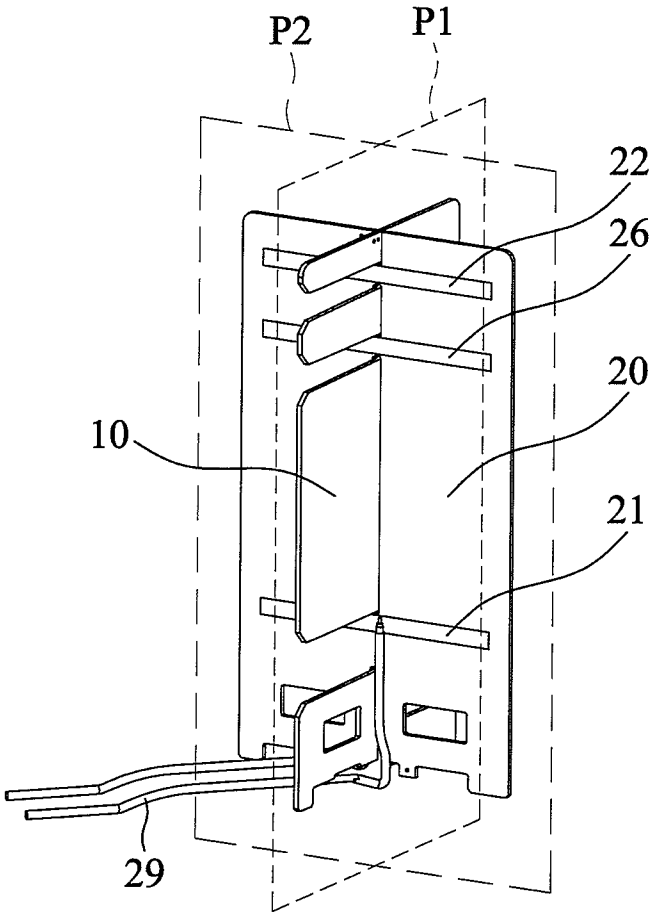
FIG. 1A shows a cross-type transmission module of an embodiment of the invention.
Figure 2:
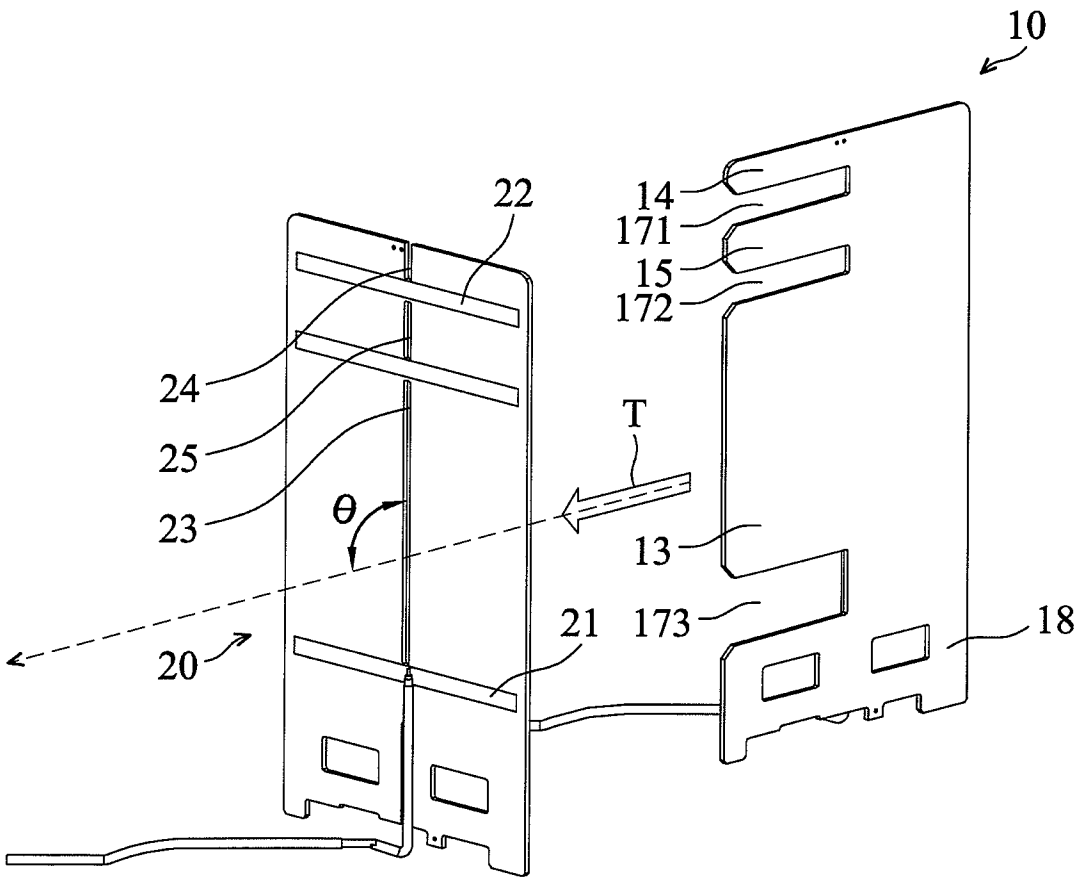
FIG. 2 shows the first circuit board assembled with the second circuit board of the cross-type transmission module of the embodiment of the invention.

FIGS. 1A, 1B and 2 show a cross-type transmission module of an embodiment of the invention, comprising a first circuit board 10 and a second circuit board 20. The first circuit board 10 comprises a first antenna 11 and a first director 12. The second circuit board 20 comprises a first groove 23 (FIG. 2), a second antenna 21 and a second director 22. The first circuit board 10 partially passes through the first groove 23 to be connected to the second circuit board 20. The first circuit board 10 is on a first plane P1, and the second circuit board 20 is on a second plane P2. The first director 12 is parallel to the first antenna 11. The second director 22 is parallel to the second antenna 21. The first director 12 and the second director 22 are continuous PCB traces.

With reference to FIGS. 1A, 1B, in one embodiment, the cross-type transmission module further comprises a first cable 19 and a second cable 29. The first cable 19 is electrically connected to the first antenna 11, and the second cable 29 is electrically connected to the second antenna 21.

In one embodiment, the second plane P2 is perpendicular to the first plane P1.

In one embodiment, the cross-type transmission module can be a cross polarization transmission module, a circular polarization transmission module or transmission module of other transmission principles.

With reference to FIGS. 1A, 1B and 2, the first circuit board 10 comprises a first connection portion 13, the first connection portion 13 passes through the first groove 23, the first antenna 11 is partially located on the first connection portion 13 and passing through the first groove 23 (in this embodiment, the first antenna 11 is formed on a lower edge of the first connection portion 13), and the second antenna 21 is neighboring an end of the first groove 23 (in this embodiment, the second antenna 21 is neighboring a lower end of the first groove 23).

With reference to FIGS. 1A, 1B and 2, the first circuit board 10 further comprises a second connection portion 14, and the second circuit board 20 further comprises a second groove 24. The second connection portion 14 passes through the second groove 24. The first director 12 is partially located on the second connection portion 14 and passes through the second groove 24 (in this embodiment, the first director 12 is formed on a lower edge of the second connection portion 14), and the second director 22 is neighboring an end of the second groove 24 (in this embodiment, the second director 22 is neighboring a lower end of the second groove 24).

With reference to FIG. 2, in one embodiment, the first circuit board 10 further comprises a third connection portion 15, and the second circuit board 20 further comprises a third groove 25. The third connection portion 15 passes through the third groove 25. A third director 16 is partially located on the third connection portion 15 and passes through the third groove 25 (in this embodiment, the third director 16 is formed on a lower edge of the third connection portion 15), and a fourth director 26 is neighboring an end of the third groove 25 (in this embodiment, the fourth director 26 is neighboring a lower end of the third groove 25). The gain of the cross-type transmission module can be improved by increasing the amount of the directors.

In the embodiment above, a first notch 171 is formed between the second connection portion 14 and the third connection portion 15, and a second notch 172 is formed between the third connection portion 15 and the first connection portion 13. The first circuit board 10 can further comprise a first base portion 18, and a third notch 173 is formed between the first base portion 18 and the first connection portion 13.

Figure 3:
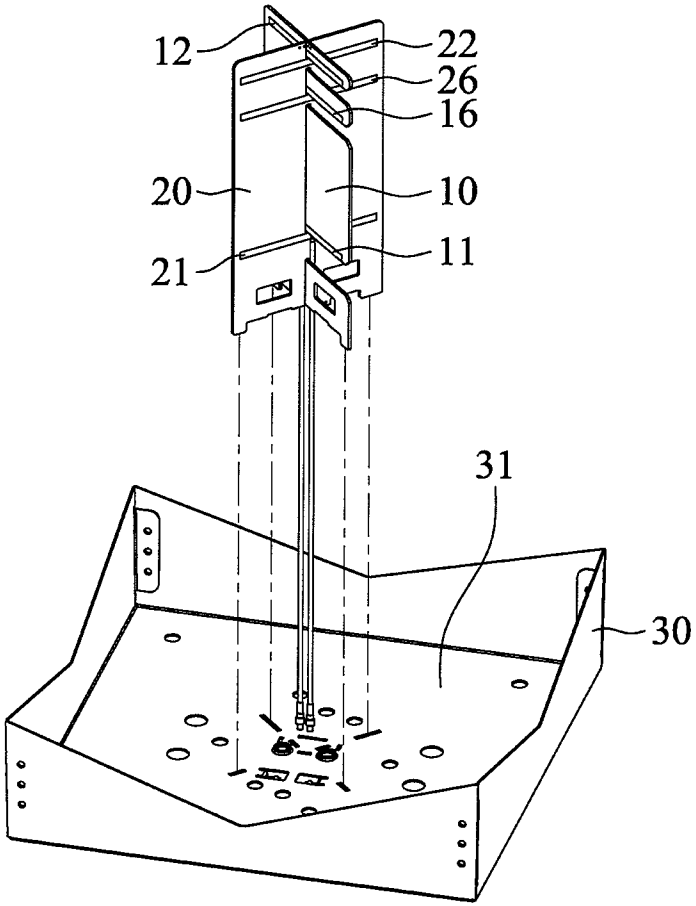
FIG. 3 shows the first circuit board and the second circuit board of the cross-type transmission module of the embodiment of the invention assembled with a reflector.

With reference to FIG. 3, the cross-type transmission module of the embodiment of the invention further comprises a reflector 30. The reflector 30 comprises a reflective surface 31, wherein the first circuit board 10 and the second circuit board 20 are inserted into the reflector 31, and the first circuit board 10 and the second circuit board 20 are perpendicular to the reflective surface 31.

The first antenna 11 is located between the first director 12 and the reflective surface 31, and the second antenna 31 is located between the second director 22 and the reflective surface 31.

With reference to FIGS. 1A and 1B, the first antenna (for example, dipole antenna) 11 comprises a first radiator 111 and a second radiator 112, the second radiator 112 is formed on the first connection portion 13, the second circuit board 20 is located between the first radiator 111 and the second radiator 112 relative to the first plane P1.

Figure 4:
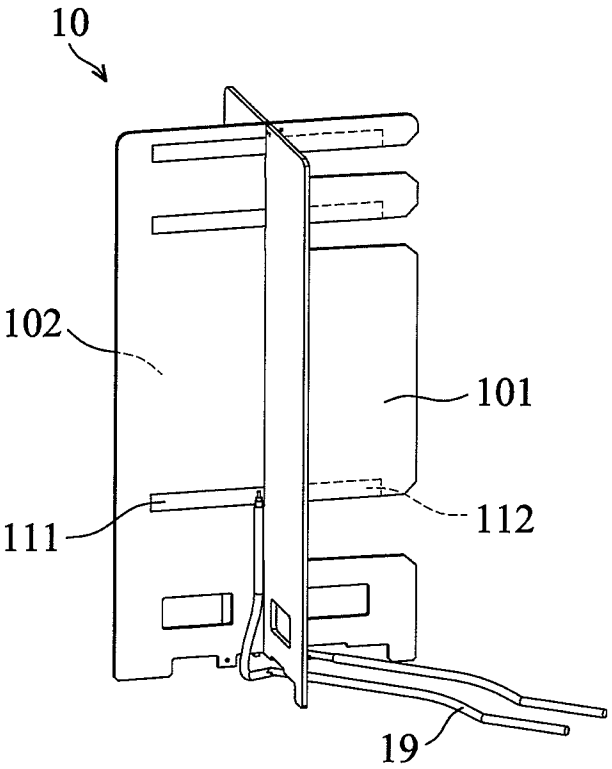
FIG. 4 shows the cross-type transmission module of a modified embodiment of the invention.

With reference to FIG. 4, in a modified example, the first circuit board 10 comprises a first surface 101 and a second surface 102, the first surface 101 is opposite to the second surface 102, the first radiator 111 is formed on the first surface 101, and the second radiator 112 is formed on the second surface 102. Similarly, the second antenna can further comprise a third radiator and a fourth radiator, and the third radiator and the fourth radiator are disposed on opposite surfaces of the second circuit board.

Figure 5:
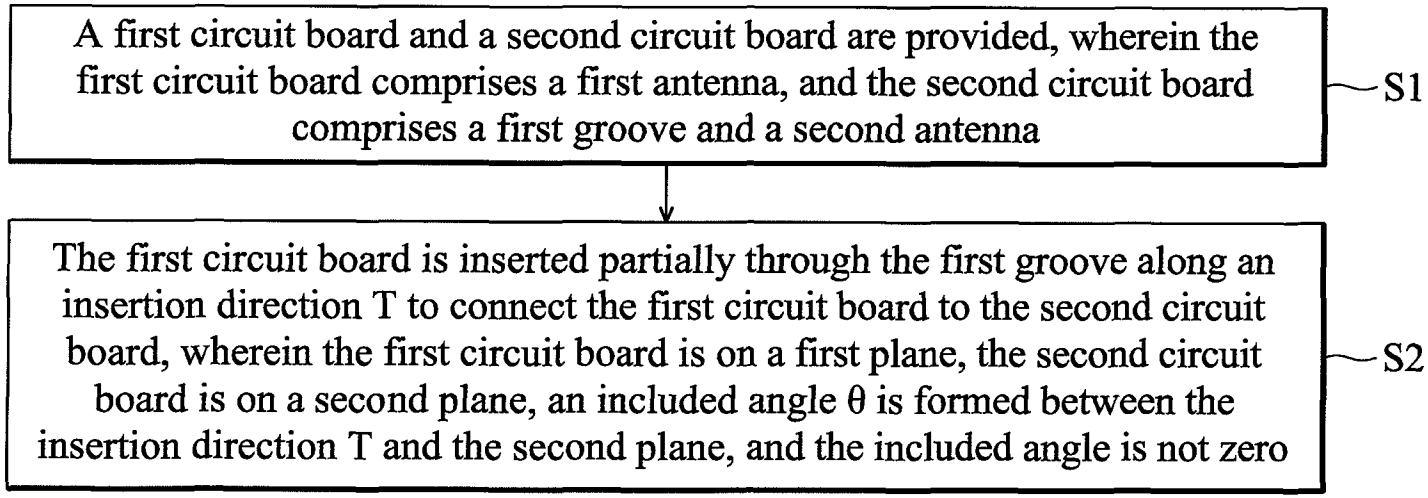
FIG. 5 shows the method for assembling the cross-type transmission module of the embodiment of the invention.

FIGS. 2 and 5 show the method for assembling the cross-type transmission module of the embodiment of the invention, which comprises the following steps. First, a first circuit board and a second circuit board are provided, wherein the first circuit board comprises a first antenna, and the second circuit board comprises a first groove and a second antenna (S1). Then, the first circuit board is inserted partially through the first groove along an insertion direction T to connect the first circuit board to the second circuit board, wherein the first circuit board is on a first plane, the second circuit board is on a second plane, an included angle θ is formed between the insertion direction T and the second plane, and the included angle is not zero (S2). In this embodiment, the included angle is 90 degrees, and the second plane is perpendicular to the first plane.

With reference to FIG. 3, the method for assembling the cross-type transmission module of the embodiment of the invention can further comprises the following steps. First, a reflector is provided wherein the reflector comprises a reflective surface (31). Then, the first circuit board and the second circuit board are inserted into the reflector after the first circuit board is assembled with the second circuit board, wherein the first circuit board and the second circuit board are perpendicular to the reflective surface (31).

Utilizing the cross-type transmission module and the assembly method of the embodiment of the invention, the first circuit board is partially inserted through the first groove along the insertion direction to connect the first circuit board to the second circuit board, and the insertion direction is perpendicular to the surface of the second circuit board. Compared to the conventional vertically intersected design, the first and second circuit boards of the embodiment of the invention are laterally intersected. Therefore, the dimension and the position of the first groove (connection groove) on the circuit board can be properly designed. The embodiment of the invention provides improved design flexibility. Additionally, the connection groove of the conventional vertically intersected design is longer, and the director cannot be disposed on the circuit board (the director would be cut off by the connection groove). In the embodiment of the invention, the first and second circuit boards are laterally intersected, the director can be disposed on the circuit board, and the length of the director can be similar to the width of the circuit board. The director can improve gain of the cross-type transmission module. The cross-type transmission module of the embodiment of the invention improves gain with low cost.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for assembling a cross-type transmission module, comprising:

providing a first circuit board and a second circuit board, wherein the first circuit board comprises a first antenna, and the second circuit board comprises a first groove and a second antenna, wherein the first groove is an enclosed groove;

inserting the first circuit board partially through the first groove along an insertion direction to connect the first circuit board to the second circuit board, wherein the first circuit board is on a first plane, the second circuit board is on a second plane, an included angle is formed between the insertion direction and the second plane, and the included angle is not zero, wherein the first circuit board comprises a first connection portion, and both the first connection portion and the first antenna pass through the first groove, wherein the first circuit board further comprises a second connection portion, the second circuit board further comprises a second groove, the second connection portion passes through the second groove.

2. The method as claimed in claim 1, wherein the included angle is 90 degrees, and the second plane is perpendicular to the first plane.

3. The method as claimed in claim 1, wherein the cross-type transmission module is a cross polarization transmission module or a circular polarization transmission module.

4. The method as claimed in claim 3, wherein the first antenna is partially located on the first connection portion and passing through the first groove, and the second antenna is neighboring an end of the first groove.

5. The method as claimed in claim 4, wherein the first circuit board further comprises a first director, the second circuit board further comprises a second director, the first director is parallel to the first antenna, the second director is parallel to the second antenna, and the first director and the second director are continuous PCB traces.

6. The method as claimed in claim 5, wherein the first director is partially located on the second connection portion and passes through the second groove, and the second director is neighboring an end of the second groove.

7. The method as claimed in claim 5, further comprising:

providing a reflector, wherein the reflector comprises a reflective surface; and inserting the first circuit board and the second circuit board to the reflector after the first circuit board is assembled with the second circuit board, wherein the first circuit board and the second circuit board are perpendicular to the reflective surface.

8. The method as claimed in claim 7, wherein the first antenna is located between the first director and the reflective surface, and the second antenna is located between the second director and the reflective surface.

9. The method as claimed in claim 4, wherein the first antenna comprises a first radiator and a second radiator, the second radiator is formed on the first connection portion, the second circuit board is located between the first radiator and the second radiator.

10. The method as claimed in claim 9, wherein the first circuit board comprises a first surface and a second surface, the first surface is opposite to the second surface, the first radiator is formed on the first surface, and the second radiator is formed on the second surface.

11. A cross-type transmission module, comprising:

a first circuit board, comprising a first antenna and a first director; and a second circuit board, comprising a first groove, a second antenna and a second director, wherein the first circuit board partially passes through the first groove to be connected to the second circuit board, wherein the first circuit board is on a first plane, the second circuit board is on a second plane, the first director is parallel to the first antenna, the second director is parallel to the second antenna, and the first director and the second director are continuous PCB traces, wherein the first groove is an enclosed groove, wherein the first circuit board comprises a first connection portion, and both the first connection portion and the first antenna pass through the first groove, and wherein the first circuit board further comprises a second connection portion, the second circuit board further comprises a second groove, the second connection portion passes through the second groove, the first director is partially located on the second connection portion and passes through the second groove, and the second director is neighboring an end of the second groove.

12. The cross-type transmission module as claimed in claim 11, wherein the second plane is perpendicular to the first plane.

13. The cross-type transmission module as claimed in claim 12, wherein the cross-type transmission module is a cross polarization transmission module or a circular polarization transmission module.

14. The cross-type transmission module as claimed in claim 13, wherein the first antenna is partially located on the first connection portion and passing through the first groove, and the second antenna is neighboring an end of the first groove.

15. The cross-type transmission module as claimed in claim 14, wherein the first antenna comprises a first radiator and a second radiator, the second radiator is formed on the first connection portion, the second circuit board is located between the first radiator and the second radiator.

16. The cross-type transmission module as claimed in claim 15, wherein the first circuit board comprises a first surface and a second surface, the first surface is opposite to the second surface, the first radiator is formed on the first surface, and the second radiator is formed on the second surface.

17. The cross-type transmission module as claimed in claim 11, further comprising:

a reflector, wherein the reflector comprises a reflective surface, wherein the first circuit board and the second circuit board are inserted into the reflector, and the first circuit board and the second circuit board are perpendicular to the reflective surface.

18. The cross-type transmission module as claimed in claim 17, wherein the first antenna is located between the first director and the reflective surface, and the second antenna is located between the second director and the reflective surface.

* * * * *